United States Patent [19]

Schaffner, III

[11] 3,967,418

[45] July 6, 1976

[54] WORK POLISHING TOOL AND METHOD OF MAKING SAME

[75] Inventor: Gus J. Schaffner, III, Pittsburgh, Pa.

[73] Assignee: Schaffner Manufacturing Company, Inc., Pittsburgh, Pa.

[22] Filed: Feb. 20, 1975

[21] Appl. No.: 551,377

[52] U.S. Cl. ..... 51/334; 51/293

[51] Int. Cl.[2] ..... B24D 13/06

[58] Field of Search ..... 51/334–337, 51/293; 15/179, 183, 230.12, 230.17, 230.19

[56] References Cited

UNITED STATES PATENTS

| | | | |
|---|---|---|---|
| 339,585 | 4/1886 | Root | 51/334 |
| 2,804,730 | 9/1957 | Block | 51/337 |
| 2,808,689 | 10/1957 | Thompson | 51/337 |
| 3,165,867 | 1/1965 | Murray | 51/334 |
| 3,533,198 | 10/1970 | Burns | 51/337 |
| 3,535,833 | 10/1970 | Belanger | 51/337 |
| 3,645,049 | 2/1972 | Freerks et al. | 51/334 |
| 3,711,261 | 1/1973 | Burns | 51/334 |
| 3,807,099 | 4/1974 | Belanger | 51/337 |

*Primary Examiner*—Al Lawrence Smith
*Assistant Examiner*—Nicholas P. Godici
*Attorney, Agent, or Firm*—Hymen Diamond

[57] ABSTRACT

A work-polishing tool including a rigid annular core having at spaced intervals around its periphery strips of readily-deformable material such as sheet rubber. These strips extend radially outwardly from the core and each has leaves of abrasive fabric secured to its extending end. The inner ends of the leaves are spaced an appreciable distance, for example, one fourth inch, from the outer periphery of the core. The core may be formed of an annulus of thin spacers in which the strips of readily-deformable material are interspersed at spaced intervals and which is rigidified or solidified by injecting adhesive, for example, an epoxy resin and a hardener, between the spacers and between the spacers and the adjacent strips and permitting the adhesive to solidify. The strips may be folded over so that they are of U-longitudinal section and the leaves secured to the arms of the U. A loop is then formed into which a block of cardboard or the like is inserted. The loops with the blocks and spacers are then locked together on a metal ring into a rigid annulus. Separate pluralities of leaves may also be connected to each folded-over strip of U-section. The strips are then strung onto a metal ring and an anchor pin is interposed between the head of each strip and the ring. The strips and anchor pins are then locked into a rigid annulus.

18 Claims, 12 Drawing Figures

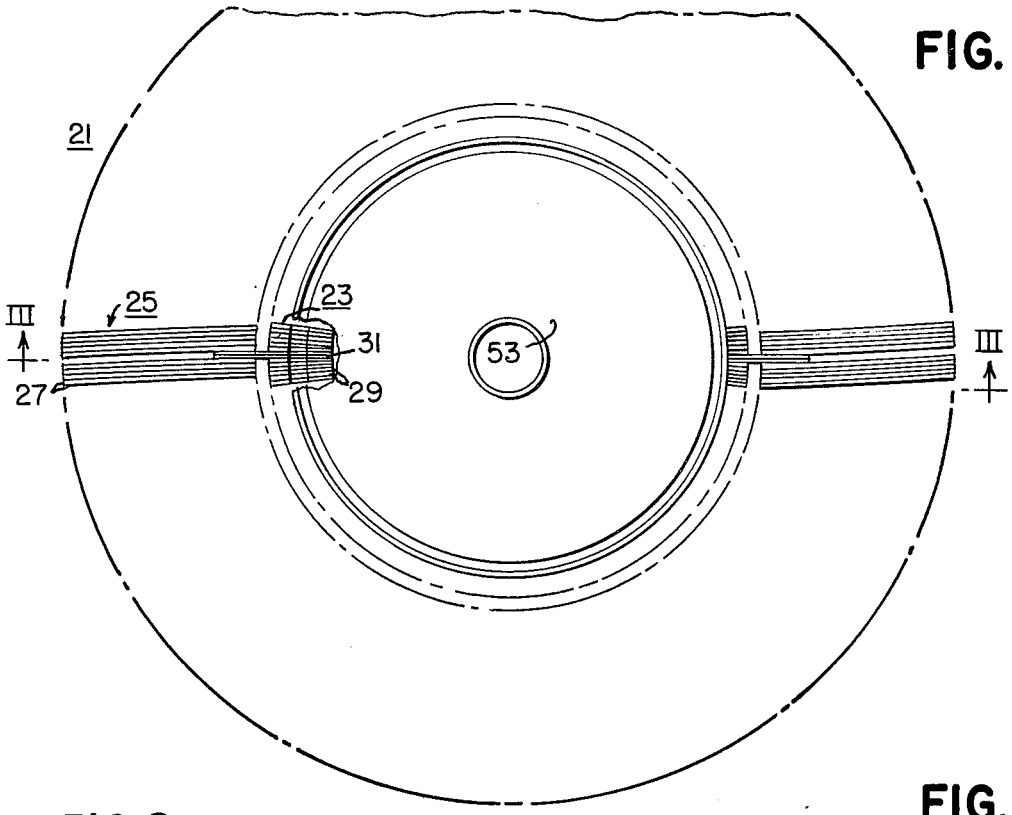
FIG.1
FIG.2
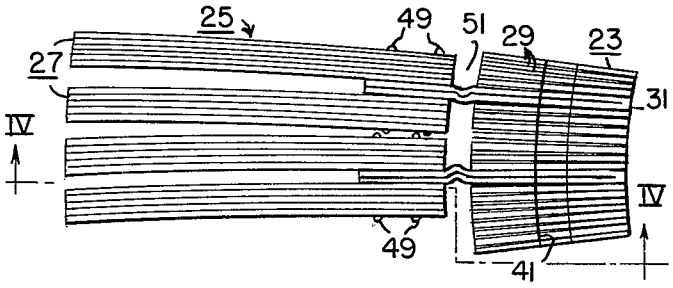
FIG.4
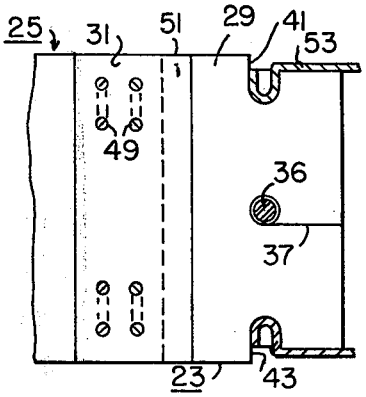
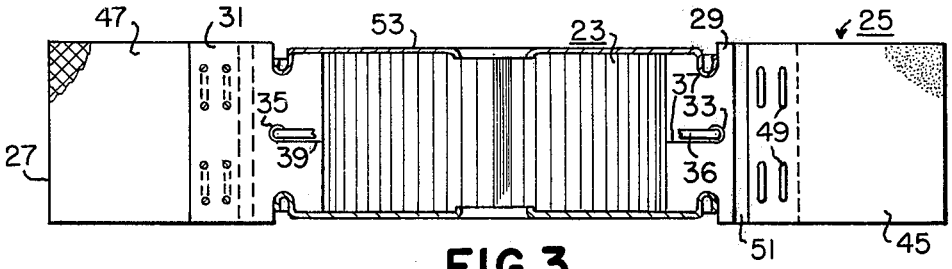
FIG.3

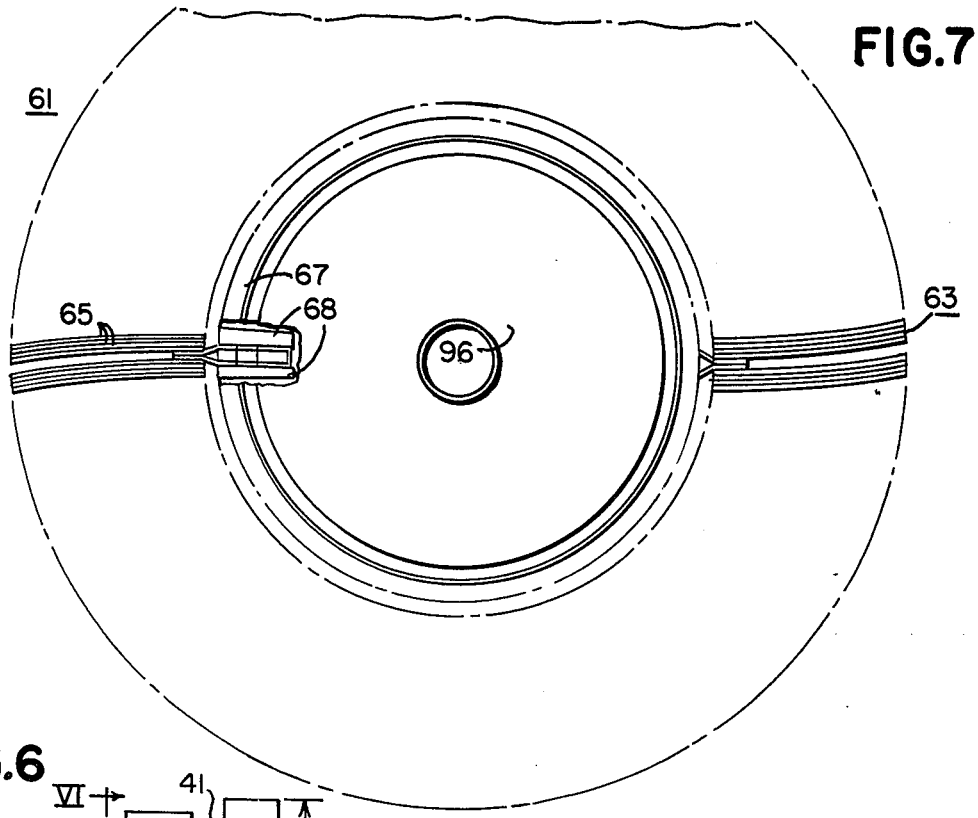
FIG.7
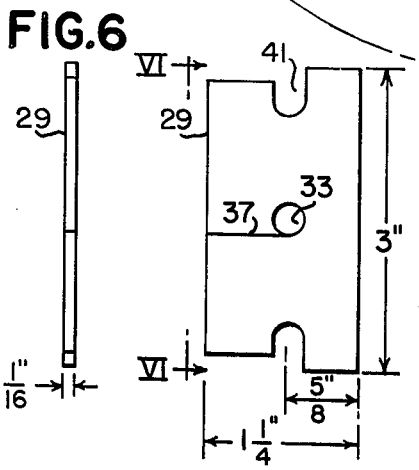
FIG.6
FIG.5
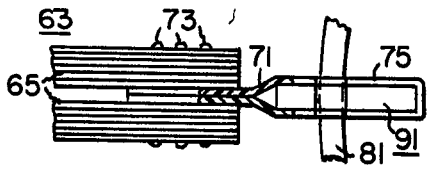
FIG.9
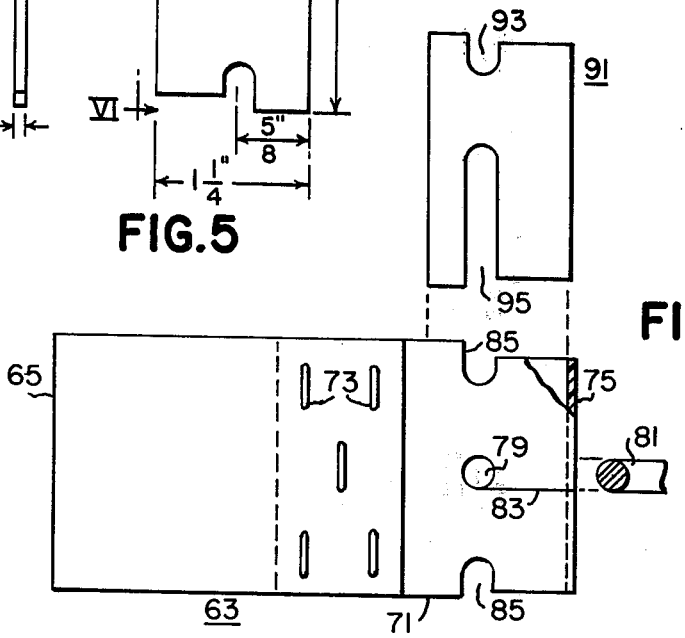
FIG.8

WORK POLISHING TOOL AND METHOD OF MAKING SAME

REFERENCE TO RELATED DOCUMENTS

References incorporated in this application by reference: Schaffner U.S. Pat. Nos. 3,206,894 and 3,294,802.

BACKGROUND OF THE INVENTION

This invention relates to the polishing art and has particular relationship to a polishing tool in the form of a wheel or annulus having packs or groups or pluralities or groups of leaves or flaps of polishing material extending from a central annular core. The word polishing is intended to encompass within its scope not only polishing but all types of surface treatment of work including brushing, abrasing, buffing, burnishing or coloring, and finishing. In the use of the polishing tool with which this invention concerns itself, the work is held firmly in engagement with the outer periphery of the leaves while the tool is rotated and the leaves react with the surface of the work in the desired manner.

As evidenced by the great number of patents which have been granted on the above-described tool, numerous attempts have for many years been made to provide a satisfactory tool of this type. The tools which have resulted from this effort have important disadvantages.

In accordance with, and typical of, this prior art teaching the packs of leaves pivot about the edge of a groove as do the packs 11 (FIG. 1) of Cosmos Ser. No. 2,871,632 or about a pin or hinge as do the packs 36 (FIG. 2) or 76 (FIG. 6) of Belanger U.S. Pat. No. Re. 28,118. In either case the rigidity of the pivoting action does not permit the leaves to adjust or adapt themselves positionally to the work in the manner desired. In addition, in tools such as is disclosed by Cosmos, the leaves of each pack slide relative to each other and abrasive coatings of the leaves below the outer leaf are worn. The tools operate in an atmosphere of abrasive dust and the pins and hinges of such tools as are disclosed by Belanger become covered with the abrasive and stick or are otherwise deteriorated. Tools such as Belanger's are also of excessive weight because of their large number of pins which are composed of metal.

It is accordingly an object of this invention to overcome the disadvantages of the prior art and to provide a polishing tool which includes a hub from whose periphery an annulus of packs of polishing leaves extend and, in the use of which tool the leaves shall adjust or adapt themselves positionally to the work being polished. It is also an object of this invention to provide such a tool of relatively light weight whose leaves shall not pivot about pins or hinges and in the use of which the leaves of the various packs shall not slide relative to each other. It is also an object of this invention to provide a method of making a tool for polishing work that shall not suffer from the disadvantages of the prior art. It is further an object of this invention to provide packs of leaves for the above-described polishing tool.

SUMMARY OF THE INVENTION

In accordance with this invention a tool for polishing work is provided whose packs of leaves are secured to readily-deformable strips which are elements of a rigid core from which they extend at spaced intervals. The strips may be composed of rubber sheet, cloth, or any other strong, flexible web. The ends of the strips opposite the packs of leaves are secured in the core. The inner ends of the leaves are spaced an appreciable distance from the outer periphery of the core so as to provide a readily-deformable neck which permits the leaves to adjust themselves positionally to the surface of the work.

In accordance with an aspect of this invention the core is formed of thin spacers and the inner ends of the strips. The spacers and strips are formed into an annulus with the strips interleaved with the spacers at equal intervals or angles. An adhesive is injected between the spacers and between the strip ends and adjacent spacers and permitted or caused to be solidified or to set to form a rigid core. The leaves usually are attached to the strips before they are integrated into the core.

In accordance with another aspect of this invention each strip of readily-deformable material is folded over into U-shaped cross-section and secured at the arms of the U-shaped strip to a pack of leaves providing a loop or pocket at the other end. A block is inserted in each loop and the filled loops and spacers are mounted on a metal, usually steel, ring to form a mechanically locked annulus with the packs of leaves radiating from the annulus. The annulus is locked mechanically into a rigid core which requires no adhesive between the spacers and between the pockets and adjacent spacers.

In accordance with a further aspect of this invention a strip of U-longitudinal cross-section is formed by folding over a longer strip or a plurality of strips of readily-deformable material and separate packs of leavess are secured to each arm of each U-shaped strip. The pack assemblies so formed are strung on a metal ring and anchor pins are interposed between the ring and the head of each strip. The strip heads stiffened by the anchor pins and spacer pins are then mechanically locked into a rigid annulus.

BRIEF DESCRIPTION OF THE DRAWING

For a better understanding of this invention, both as to its organization and as to its method of operation, together with additional objects and advantages thereof, reference is made to the following description taken in connection with the accompanying drawings, in which:

FIG. 1 is a view in side elevation of a polishing tool in accordance with this invention;

FIG. 2 is a fragmental view enlarged in side elevation and partly in section of the tool shown in FIG. 1, showing the manner in which this tool is formed;

FIG. 3 is a section taken along line III13 III of FIG. 1;

FIG. 4 is a section taken along line IV—IV of FIG. 2;

FIG. 5 is a view in side elevation of a spacer used in the tool shown in FIG. 1 showing typical important dimensions;

FIG. 6 is a view in end elevation of the spacer shown in FIG. 1 as seen from direction VI in FIG. 5 also showing typical dimensions;

FIG. 7 is a view in side elevation of a polishing tool in accordance with a modification of this invention;

FIG. 8 is a fragmental exploded view partly in section showing the manner in which the readily-deformable strip of the tool shown in FIG. 7 is formed;

FIG. 9 is a fragmental view in side elevation and partly in section showing the part of the tool which is shown in FIG. 7 including the readily-deformable strip;

Figure 10:
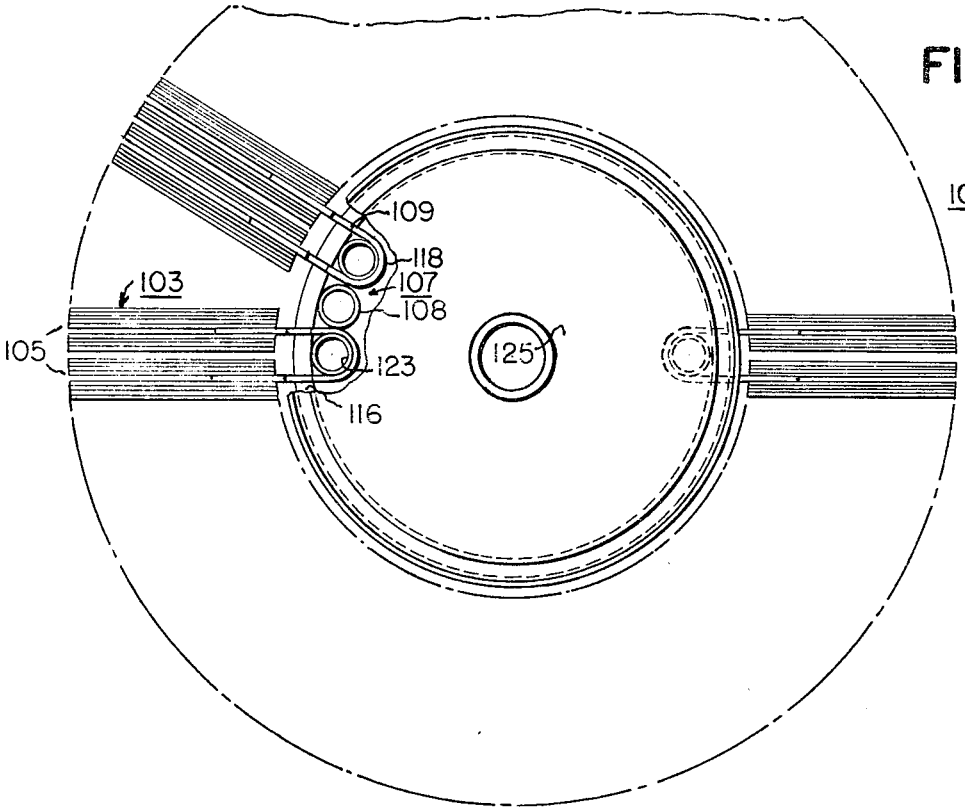
FIG. 10 is a view in side elevation of a polishing tool in accordance with another modification of this invention.

The dimensions in FIGS. 5 and 6, and any other dimensions mentioned in this application, are included only for the purpose of aiding those skilled in the art to practice this invention and not with any intention of limiting this invention in any way.

DETAILED DESCRIPTION OF INVENTION

The apparatus shown in FIGS. 1 through 6 includes a tool 21 for polishing work. The tool 21 is of annular form including an annular core 23 from which pack assemblies 25 of leaves 27 of polishing material extend at uniformly spaced angular intervals around the core 23.

The core 23 is composed of a plurality of spacers 29 (FIGS. 5 and 6) and of strips 31 of readily-deformable material, interposed at intervals between the spacers 29. Typically, the spacers 29 are composed of cardboard or plastic or fabric and have the dimensions shown in FIGS. 5 and 6. The strips 31 are typically composed of sheet rubber, such as neoprene with a nylon insert (reinforcement), about 0.022 to 0.025 inch in thickness and may be folded over to double thickness as shown in FIG. 2. The rubber is acquired under the designation nylon-inserted neoprene. Each spacer 29 and each strip 31 is provided with a hole 33 and 35 (FIG. 3) respectively to accommodate a solid metal (steel) ring 36 and each spacer and strip has a slit 37 and 39 between one end, (the inner end) and the hole 33 or 35 so that the spacers 29 and strips 31 may be strung on the ring 36. Each spacer 29 and each strip 31 is provided with notches 41 and 43 respectively. The strips 31 extend radially outwardly from the core 23 and packs of leaves 27 are secured to the extending ends. The ring 36 may also be separable at one point with overlapping ends at the point. In this case the spacers and strip need not have slits 37 and 39.

The leaves 27 are composed of a fabric, such as is disclosed in the Schaffner patents, coated with an abrasive on one side 45 and uncoated on the opposite side 47. The leaves may also be coated on both sides or they may be formed of abrasive non-woven fabric of the type disclosed in Schaffner U.S. Pat. No. 3,706,167 or, as disclosed in this latter patent, partly of woven abrasive-coated fabric and partly of non-woven abrasive fabric.

The leaves 27 are secured to the strips 31 by fasteners, typically staples 49 with a strip 31 interposed between two stacks of leaves 27. A neck 51 of appreciable length of strip 31 separates the leaves 27 from the outer periphery of the core 23. As indicated by the kink in the neck 51 (FIG. 2), the strips 31, which as stated are formed of readily deformable material, are readily radially collapsible in the use of the tool. With the core 23 formed into an annulus the notches 41 and 43 form an annular groove in which flanges 53 are held. The flanges 53 serve to support a drive-shaft (not shown) for the tool 21.

A typical tool 21 has an outside diameter of about 16 inches with a core 23 having an outside diameter of about 8 inches. The leaves 27 have a length of about 3¾ inches and the neck 51 has a length of ¼ inch. Typically there are about 14 leaves 27 in each pack assembly 25, 7 on each side of the strip 31. Each pack assembly has a width of about ½ inch and a depth of about 3 inches. The ring 36 has a diameter of 3/16 inch. In the 16-inch tool there are 50 pack assemblies 25. The strips 31 to which these assemblies are secured are distributed at intervals of about 7.2° around the core 23.

In the practice of this invention the spacers 29 and core 23 are assembled on the ring 36 into a tight annulus as taught by the Schaffner U.S. Pat. Nos. 3,206,894 and 3,294,802. The spacers 29 and strips 31 are inserted in the annulus in bundles properly oriented and slipped onto the ring 36. When the annulus 23 is substantially complete, adjacent spacers 29 at one point are clamped back tightly to define a truncated sector. A bundle of spacers 29 or of spacers 29 and strips 31 are inserted into the sector and the adjacent elements are released to form a tight annulus. An adhesive as taught by the Schaffner patents '894 and '802 is then injected between the spacers 29 and between each strip 31 and its contiguous spacers. By permitting the adhesive to set, a rigid core is formed. Preferably the leaves 27 are attached to the strips 31 before the strips are slipped onto the ring 36 to form an annulus with the spacers 29.

The apparatus shown in FIGS. 7, 8, 9 is a tool 61 also including an annulus of pack assemblies 63 of leaves 65 of polishing material extending radially from a rigid core 67. In this case the core 67, rather than being formed with a set adhesive between its elements, is mechanically locked into a rigid annulus including the assemblies 63 and spacers 68 (FIG. 7).

Each pack assembly includes a strip 71 of readily-deformable material, such as nylon-inserted neoprene. The strip 71 is formed by folding over a longer strip or several strips of the material. The arms of the strip 71 are secured centrally between the stacks of leaves 65 by staples 73 forming a loop 75 at the opposite end or head of the strip. Within the loop 75 both sides of the strip 71 are provided with holes 79 to accommodate a solid metal (steel) ring 81 from which slits 83 extend. Both sides of the strip 71 are also provided with notches 85. Inwardly from the notches 85 the strip 71 is of somewhat reduced width so that it has the general form of a T with a long head and a short stem.

The strips 71 are strung onto the ring 81. Then a block or board 91 of cardboard, masonite or plastic is inserted in each loop 75. The block 91 (FIG. 8) has the same general form as the strip, being somewhat wider outwardly of the core 67 than inwardly. A notch 93 extends from the block 91 into one end and a slot 95 capable of accommodating the ring 81 into the other end. After the strip 71 is slipped onto the ring 81, the block 91 is inserted into the loop 75; the slot 95 is slid onto the ring 81; the ring 81 seating in the inner surface of the slot 95. Typically for a wheel of 16-inch outside diameter having a core of 8-inch outside diameter the blocks 91 have a thickness of about ¼ inch.

The spacers 68 are similar to the blocks 91 having notches and slots (not shown) similar to the notch 93 and the slot 95. The spacers 68 are seated on the ring 81 at points intermediate the stiffened loops 75. With the spacers 68 of proper thickness only one spacer is inserted between each pair of loops 75. After the annulus of spacers 68 and loops 75 is substantially complete, two adjacent spacers 68 at a point in the annulus are clamped apart and a loop is forced into the space between the clamped elements. Alternatively two loops 75 may be clamped apart and a spacer forced in. The annulus is thus locked into a rigid structure. The notches 85 and 93 and the notches 85 and the ends of the slots 95 and the notches and slots of the spacers 68 are coextensive providing grooves for holding flanges 96. The stacks of leaves 65 are attached to the strips 71 before the strips 71 are assembled on the ring 81.

Figure 12:
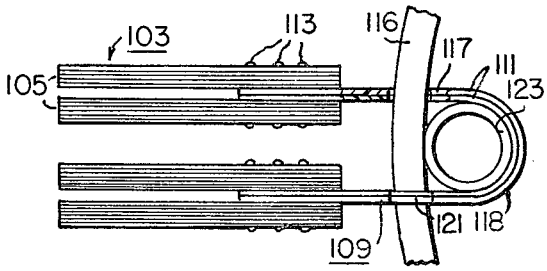
FIG. 12 is a fragmental view in side elevation showing the part of the polishing tool shown in FIG. 10 including the readily-deformable strip.
Figure 11:
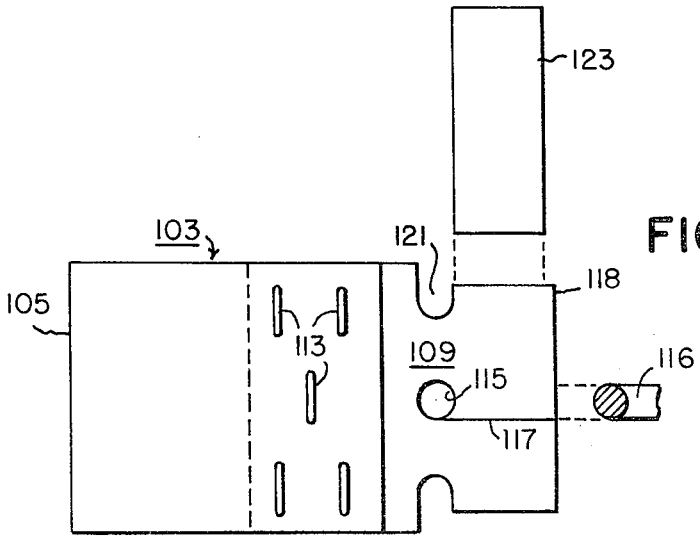
FIG. 11 is a fragmental exploded view showing how the readily-deformable strip of the tool shown in FIG. 10 is assembled.

The apparatus shown in FIGS. 10, 11, 12 is a polishing tool 101 including a plurality of pack assemblies 103 of polishing leaves 105 extending from a mechanically-locked annular core 107 including the assemblies 103 and spacers 108. The assemblies 103 extend at equal angular intervals around the core 107.

Each assembly 103 includes a strip 109 of a readily-deformable material such as nylon-inserted neoprene. The strip 109 is of generally U-longitudinal section and is formed by folding over a pair or several layers of longer strips 111 as shown in FIG. 12. A separate pack of leaves 105 of polishing material is secured to each arm of strip 109 by staples 113. Each side of a strip 109 is provided with a hole 115 for accommodating a solid metal (steel) ring 116. The holes 115 are joined to the head 118 of the strip 109 by slits 117. Each strip 109 is of somewhat larger width outwardly than it is inwardly of the core having the general form of T with a long head and a short stem. Notches 121 join the wider edges of the strip 109 to the narrower edges. The stacks of leaves 105 are first secured to the arms of the strip 109. Then a plurality of strips 109 are slipped through the slits 117 and seated on the ring 116 in an annulus. An anchor pin 123 which may be a hollow tube is inserted between the ring 116 and the head 118 of each strip. The pin 123 is of such diameter that the fabric at the head 118 is tensioned so that the pin 123 is held tightly between the ring 116 and the head 118. The spacers 108 are similar to the anchor pins 123. A spacer 108 is inserted between each pair of adjacent strips 109 producing a mechanically locked annulus. The notches 121 are coextensive providing a groove for holding flanges 125 for securing a shaft to drive the tool.

The typical dimensions and structure of the leaves 65 and 105 respectively and the strips 71 and 109 are similar to the typical corresponding dimensions of the apparatus shown in FIGS. 1 through 6. In the tools shown in FIGS. 7 through 9 and 10 through 12 the outer periphery of each annulus 67 and 107 respectively is separated from the inner ends of the corresponding packs 63 and 105 by a neck 131 and 133 respectively.

While preferred embodiments have been disclosed herein, many modifications thereof are feasible. This invention is not to be restricted except insofar as is necessitated by the spirit of the prior art.

I claim:

1. A tool for polishing work comprising an annulus of spacers having interposed at intervals therebetween readily radially collapsible strips of a material which is readily deformable to provide said collapsible function in use of the tool, said strips extending radially outwardly from said annulus, said spacers and strips being secured together by an adhesive into a rigid central core from which said strips extend freely, and a plurality of leaves of a polishing material secured to the portion of each of said strips which extends from said core.

2. The tool of claim 1 wherein the leaves are secured to the strips with their inner ends an appreciable distance from the outer periphery of the core to enable said leaves to adjust themselves positionally to work being polished by deformation of the portion of said strips between said core and said leaves.

3. A tool for polishing work comprising a rigid core, readily radially collapsible strips of a material which is readily deformable to provide the collapsible function in use of the tool, secured to, and extending freely radially outwardly from said core at spaced intervals along said core, and a plurality of leaves of a polishing material secured to the portion of each said strip extending radially outwardly at a position spaced an appreciable distance from said core to enable said leaves to adjust themselves positionally to said work being polished by deformation of the portions of said strips between said leaves and said core.

4. The tool of claim 3 wherein the core is formed of a plurality of thin spacers formed into an annulus with the strips interposed between contiguous spacers at the intervals and extending radially outwardly from the annulus, the spacers and the strips being secured together into a rigid core by an adhesive.

5. The tool of claim 4 including a ring of metal on which the spacers and the strips of web are strung for reinforcing the core.

6. The tool of claim 3 wherein the number of leaves secured to each readily-deformable strip is substantially greater than two.

7. A pack assembly for a tool for polishing work including a strip of readily-deformable material having a plurality of leaves of polishing fabric secured thereto, said strip being readily collapsible along the direction longitudinally of the leaves, the ready deformability of said material providing the collapsible function in the use of the tool.

8. The pack of claim 7 wherein the strip is folded over forming at its end at least two layers of readily-deformable material, to which the leaves are secured, with a loop extending from said end, the said pack also including a block within said loop.

9. The pack assembly of claim 7 wherein the strip is of generally U-longitudinal cross-section and a plurality of leaves is secured to each arm of the strip of U-section, the said pack including an anchor engaging internally the head of each strip.

10. The pack of claim 7 wherein the number of leaves secured to the strip is substantially greater than two.

11. The pack assembly of claim 10 wherein the strip is interposed between the leaves, certain of said leaves being on one side of said strip and the remainder on the opposite side.

12. The pack assembly of claim 11 wherein the strip is secured to the leaves by fasteners injected into the leaves on one side of the strip and penetrating through the strip and through the leaves on the opposite side of the strip.

13. A tool for polishing work comprising a rigid core, strips of a readily-deformable material secured to, and extending freely radially outwardly from said core at spaced intervals along said core, and a plurality of leaves of a polishing material secured to the portion of each said strip extending radially outwardly at a position spaced an appreciable distance from said core to enable said leaves to adjust themselves positionally to said work being polished by deformation of the portions of said strips between said leaves and said core, said strips being formed of readily deformable material folded over, providing at its end at least two layers of said readily deformable material, to which the leaves are secured and from which layers a loop extends, each said loop having a block therein, said tool also including spacers, the core being formed of an annulus of said loops, each having a block therein, with said spacers interposed between said loops, said loops and spacers being packed tightly so that they are locked mechanically into a tight annulus to form said core.

14. The tool of claim 13 including a ring of metal on which the loops, blocks and spacers are strung for reinforcing the core.

15. The tool of claim 13 wherein each strip is of generally U-longitudinal cross-section with separate pluralities of leaves secured to each of the arms of the U, the said tool including a plurality of anchors and the head of each U-shaped strip being engaged internally by an anchor, the said tool also including spacers and the core being formed of a tightly packed annulus of the heads of the strips with anchors therein with said spacers interposed between said heads.

16. The tool of claim 15 including a ring of metal interposed between the heads of said strips with the anchors therein and the spacers and the pluralities of leaves for reinforcing the core, the strips being strung on the ring.

17. The method of producing a tool for polishing work with parts including strips of readily-deformable material, blocks, spacers, a metal ring, and leaves of polishing material, the said method comprising folding each of said strips to form a strip of generally U-longitudinal cross-section, securing to the arms of each of said U-section strips a plurality of said leaves so that a loop of strip extends from each of said plurality of leaves, stringing a plurality of said strips on said ring, said ring extending through said loop and said leaves extending radially outwardly from said ring spaced an appreciable distance from said loop, inserting blocks in each of said loops, each said block seating on the portion of the ring passing through each said groove and forming said loops with the blocks therein and with said spacers interposed between said loops and seated on said rings into a locked annulus forming a rigid core of said tool from which core said leaves extend radially.

18. The method of producing a tool for polishing work with parts including strips of deformable material, a metal ring, a plurality of anchors, a plurality of spacers, and a plurality of leaves of polishing material, the said method comprising folding each of said strips to form a strip of generally U-longitudinal cross-section, securing a plurality of leaves to each of the arms of each U-strip, stringing said strips on said ring with said pluralities of leaves extending radially outwardly from said ring, said leaves being spaced an appreciable distance from said ring, inserting an anchor between the head of each U-strip and said ring, and forming said strips and said spacers into a tightly locked annulus reinforced by said ring.

* * * * *